US005979462A

United States Patent [19]

Jones

[11] Patent Number: 5,979,462

[45] Date of Patent: Nov. 9, 1999

[54] HAIR APPLIANCE

[76] Inventor: Mary Phillips Jones, 112 Woodruff Ct., Moore, S.C. 29369

[21] Appl. No.: 09/201,941

[22] Filed: Dec. 1, 1998

[51] Int. Cl.[6] ..... A41G 5/00

[52] U.S. Cl. ..... 132/54; 132/201

[58] Field of Search ..... 132/201, 53, 54, 132/55, 274

[56] References Cited

U.S. PATENT DOCUMENTS

| | | | |
|---|---|---|---|
| Re. 34,186 | 3/1993 | Moen | 132/53 |
| D. 376,444 | 12/1996 | Buckwalter | D28/92 |
| 3,273,570 | 9/1966 | Allison | 132/53 |
| 3,435,832 | 4/1969 | Ito | 132/54 |
| 3,444,865 | 5/1969 | DeVita | 132/53 |
| 3,613,695 | 10/1971 | Kazdin | 132/53 |
| 3,651,821 | 3/1972 | Mielke | 132/53 |
| 3,694,819 | 10/1972 | Meyer | 3/1 |
| 3,734,105 | 5/1973 | Borghese | 132/53 |
| 3,777,768 | 12/1973 | Seigliano | 132/53 |
| 3,862,638 | 1/1975 | Fannin | 132/53 |
| 3,910,292 | 10/1975 | Izzo | 132/53 |
| 4,016,889 | 4/1977 | Cowles | 132/56 |
| 4,600,029 | 7/1986 | Ueberschaar | 132/53 |
| 4,966,173 | 10/1990 | Russell | 132/54 |
| 5,044,382 | 9/1991 | Ando et al. | 132/53 |
| 5,406,971 | 4/1995 | Taylor | 132/201 |
| 5,551,452 | 9/1996 | Barlow | 132/53 |

FOREIGN PATENT DOCUMENTS

| | | | |
|---|---|---|---|
| 2164002 | 6/1973 | Germany | 132/53 |

*Primary Examiner*—Todd E. Manahan
*Attorney, Agent, or Firm*—Douglas W. Kim; Robert R. Reed; Cort Flint

[57] ABSTRACT

A hair appliance providing a naturally, secure, comfortable hair supplement for enhancing the cosmetic appearance of an individual having a head net with a fitted band, surrounding tracks and vertical spacers. Hair, natural or artificial, is carried by at least the surrounding tracks and blends with the natural hair of the wearer. The head net construction allows the personal hair of the wearer to be pulled through the hair opening defined by the fitted band and tracks so the personal hair of the wearer and the appliance hair is blended together to provide a naturally appearing, secure, comfortable appearance. The hair appliance can also provide bangs when a front bang section is included. Additionally, the appliance hair can terminate at a variable length or at generally the same length.

7 Claims, 2 Drawing Sheets

HAIR APPLIANCE

BACKGROUND OF THE INVENTION

This invention relates to a hair appliance which allow the wearer's natural hair to be supplemented and naturally blended with appliance hair thus providing for increased thickness, increased length, varying color, differing styles and differing textures.

The popularity of hair supplements for cosmetic use has dramatically increased in the recent years. The desire to enhance one's physical appearance is more prevalent in today's society than ever. Traditionally, the desire to change or alter one's hair was accomplished through the use of such devices as wigs, hair weaves or partial hair supplements.

Wigs, while well known in the art, still contain many problems to which much attention need be given. For example, wigs are hot, itchy and otherwise uncomfortable since they completely cover an entire portion or even the entire scalp. U.S. Pat. No. 3,862,638 illustrates such a wig which completely covers the wearer's head. Wigs also appear bulky since the wearer's personal hair is compressed under the wig. Additionally, this wig and does not providing adequate ventilation to the scalp. U.S. Pat. No. 3,613,695 shows a laminated base structure which prevents ventilation from reaching the scalp. Additionally, the traditional wig needs to be removed for sleep.

Hairweaves, while allowing ventilation to the scalp, require the assistance of another individual to weave the hair into the wearer's personal hair. Methods for securing the hair weave include hair bonding glues, weaving threads, hair clips, combs, braiding, or knotting human or synthetic hair to the wearer's hair. These methods of attachment place excessive tension on the hair and scalp and causes discomfort as well as damage to the wearers hair.

While partial hair supplements have been provided, they are primarily designed to hide thinning or bald spots of the wearer. For example, U.S. Pat. No. RE 34,186 is designed to provide a cap with a small hank of hair extending from the front of the cap. The invention of U.S. Pat. No. 4,016,889 only supplements the bangs of the wearer. The invention disclosed in U.S. Pat. No. 3,651,821 describes a partial hair piece for a male. The hair piece does not surround the wearers head and only provides for partial covering. The bands of this invention are longitudinal and therefore can not encircle the wearer's head. Additionally, elastic is used to secure the hair piece to the head and causes discomfort since the hair piece is designed to be held sung onto the wearer's head. Likewise, the invention of U.S. Pat. No. 4,966,173 only cover strips on the top of the head and the invention of U.S. Pat. No. DE 376,444 only supplements the rear of the head.

Thus, the prior art has not provided a satisfactory comfortable hair appliance for supplementing the entire natural hair of a person where the natural and appliance hair may be naturally blended together to provide a full head of hair having increased thickness, length and varying color, style and texture.

Accordingly, an important object of this invention is to provide a naturally appearing hair supplement which is virtually undetectably to the observer and comfortable to wear.

Another object of this invention is to provide a hair supplement for increasing the thickness and length, varying the color, and differing the style and texture of the existing hair without requiring the assistance of another to wear the hair appliance.

Another object of this invention is to provide a hair supplement which allows for ventilation so that air can reach the scalp preventing the wearer's hair from heating.

Another object of this invention is to provide a hair supplement which can be secured to the wearer's head in a fashion which eliminates the need to remove the hair appliance before sleeping.

Another object of the invention is to provide a head net which securely fits to the wearer's head, can be worn while sleeping, and allows the appliance hair to be blended with the hair of the wearer to form a naturally appearing, virtually undetectable hair supplement.

SUMMARY OF THE INVENTION

The above objectives are accomplished according to the present invention by providing a hair appliance having a head net consisting of tracks defining hair openings for the wearer's natural hair to be pulled through and blended with the appliance hair. Spacers can be provided to ensure the tracks are properly spaced. A continuous fitted band runs approximately from the forehead of the wearer to the nape of the neck. A top surrounding track is connected to the front of the fitted band and is in a generally horizontal position near the top of the wearer's head. Lateral lower tracks encircle the head and are generally vertically spaced in relation to one another. Vertical spacers are carried by the fitted band, top surrounding track, and the lower surrounding tracks and ensure the surrounding tracks are adequately spaced when the hair appliance is worn. The vertical spacers also prevent the lower surrounding tracks from falling or sliding down the back wearer's head while the hair appliance is worn.

The fitted band, surrounding tracks, and vertical spacers provide a general bowl shape head net which conforms to the head of the wearer. This bowl shaped head net can also be conceptualized as a plurality of intersecting tracks. Either artificial or natural hair can be carried by the various tracks, vertical spacers and fitted band of the hair appliance. Appliance hair can be carried by the fitted band in a manner which allows for bangs, or can be carried in a manner as not to provide bangs.

Preferably, the appliance hair is a plurality of individual hair strands with secured ends and free ends. The secured ends are attached to the various tracks by looping the hair of the secured ends around the surrounding tracks and securing the hair to tracks through sewing or weaving. This method allows for the tracks to be made from material as thin as thread which prevents the tracks from being detected or noticed by the observer. The appliance hair than hangs down over the lower tracks further hiding the tracks from the observer. The free ends hang downward and can terminate at various levels or generally the same level to provide a layered look or a straight cut look.

The hair of the wearer is pulled through hair openings defined by the fitted band, various tracks and vertical spacers and blended with appliance hair to provide a naturally looking, comfortable, attractive hair supplement. The hair openings can be both in a vertical orientation as well as a horizontal orientation or both. By blending the hair of the wearer with the hair of the appliance, the wearer can create many different styles, looks, textures and appearances without the disadvantages of a wig or a hair weave. The blending also helps secure the tracks to the wearer's head.

This invention can also be conceptualized as a plurality of intersecting tracks. A top track generally is worn on the top of the wearer's head and a first surrounding track is carried by the top track. Adjacent lower surrounding tracks are carried by the immediately upper adjacent track to form the hair appliance. The surrounding tracks define the hair openings from which the hair sections are pulled through. Vertical spacers are used to prevent the surrounding tracks from slipping downward when the hair appliance is worn. These intersecting tracks form the head net design which allow the hair appliance to encircle and cover the entire head.

The hair appliance is worn by pulling down on the hairpiece in the front and back until it slides over the wearer's hair. After positioning the hair appliance, the wearer pulls the wearer's own hair through the hair openings between the tracks and spacers thereby integrating and blending the wearer's hair with the hair on the appliance. The circular shape of the tracks, the integration of the wearer's hair with the appliance hair and the vertical spacers hold the hair piece in place on the wearer's head without the need for glues, threads, clips, combs, braiding, or knotting.

Additionally, this process does not require lengthy, time consuming procedures, nor does it require the services of someone other than the individual to place the hair appliance on the head. The fit of the hair appliance on the wearer's head and the blending of the wearer's hair with the appliance hair holds the hairpiece on the wearer's head even when sleeping and eliminates the necessity of removing the hair appliance prior to sleep. Because of the hair openings between the tracks of hair, the scalp is visible providing a natural appearance and makes the hair appliance much less obvious than a wig. The hair openings also expose the scalp to air circulation, making the hair appliance cooler than the traditional wig.

BRIEF DESCRIPTION OF THE SEVERAL VIEWS OF THE DRAWING

The construction designed to carry out the invention will be described, together with other features.

The invention will be more readily understood from a reading of the following specification and by reference to the accompanying drawings which show an example of the invention. The following figures illustrate the present invention.

DETAILED DESCRIPTION OF THE INVENTION

Figure 1:
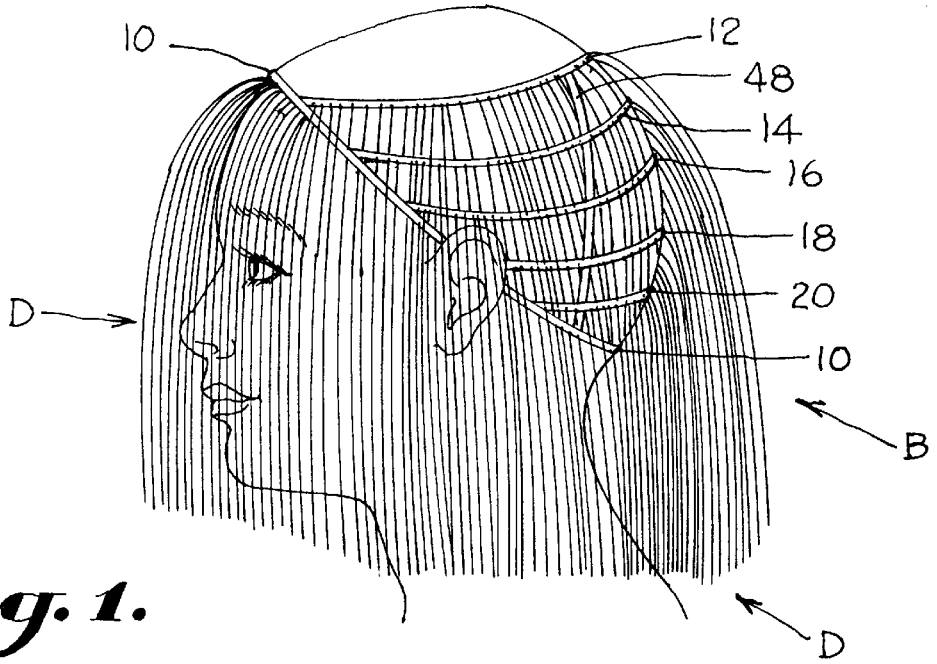
FIG. 1 is a side elevation of the invention showing the invention being worn, the natural hair of the wearer has been removed for illustrative purposes.

While the nature of this invention is designed to produce a virtually undetectable hair supplement, the drawings are illustrated with a minimal of personal hair and appliance hair to facilitate a more through understanding of the invention. Of course, when the hair appliance is worn, the structural features shown in the drawings are not readily apparent to the observer.

Figure 2:
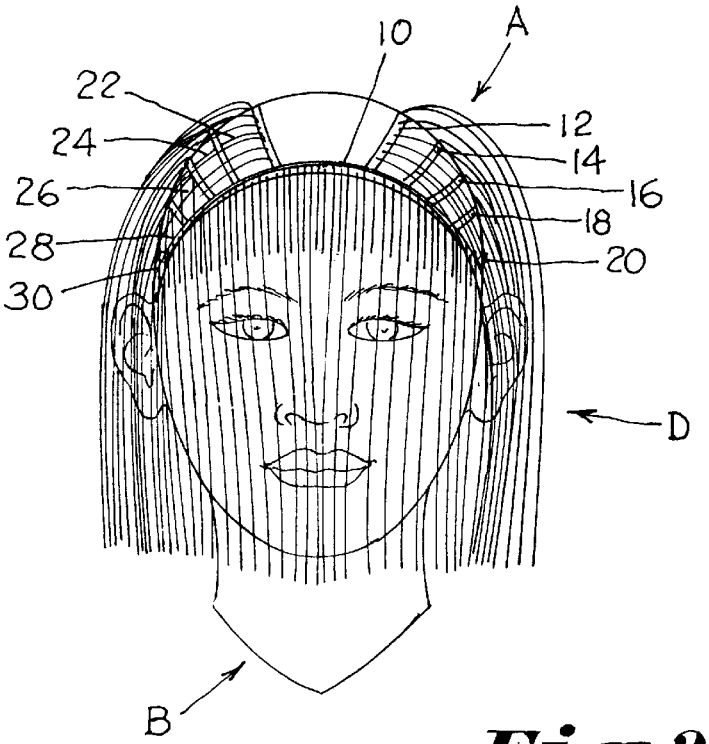
FIG. 2 is a rear elevation showing the invention being worn, the natural hair of the wearer has been removed for illustrative purposes.
Figure 3:
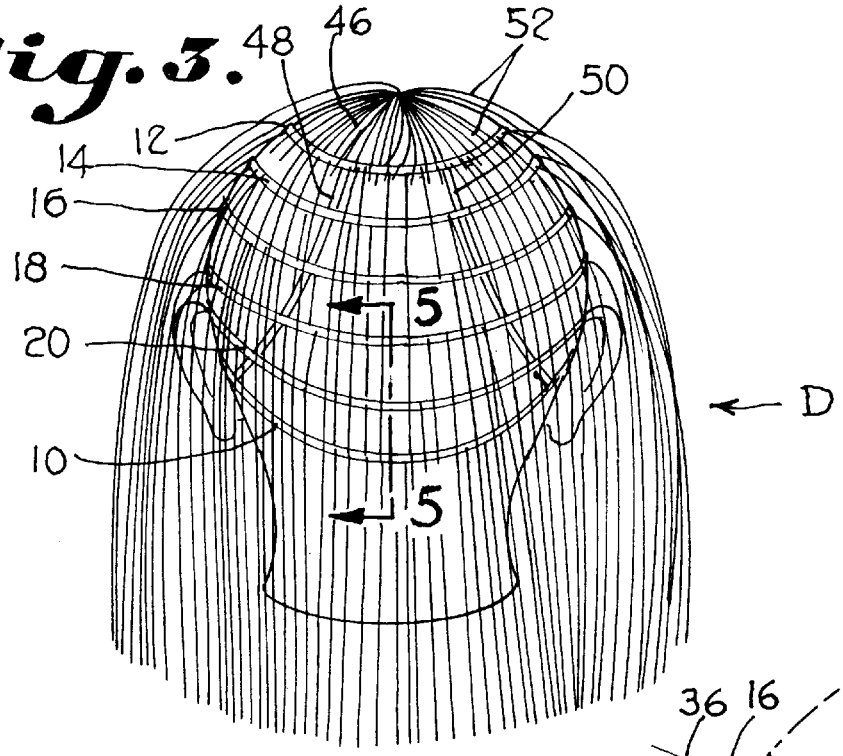
FIG. 3 is a rear elevation showing the invention being worn, including natural hair of the wearer appearing on the top of the head.
Figure 5:
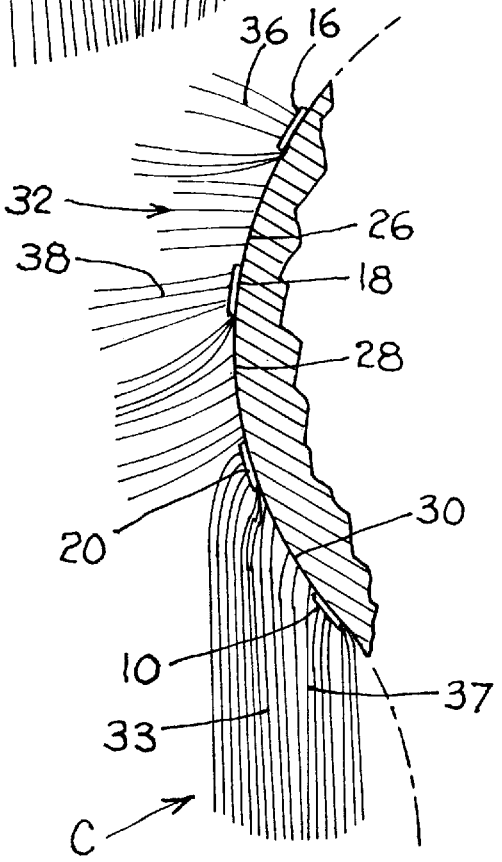
FIG. 5 is a cross-sectional view from FIG. 3 along line 5—5, showing a detailed view of the invention and personal hair both separated and blended when the hair appliance is worn.

Referring to the drawings, the invention will be described in more detail. FIG. 2 shows generally the hair appliance with head net A which contains fitted band 10 encircling the head from the forehead to the nape of the neck. In the preferred embodiment, this fitted band is made of a thin string which is virtually undetectable to the observer. Appliance hair, made from natural or artificial hair, is carried by the head net and specifically by the fitted band and surrounding and appliance hairtracks 12,14,16,18, and 20. FIGS. 1,2, and 3 show the appliance hair generally as D. FIG. 5 shown appliance hair specifically as 35, 36, 37 and 38.

In a preferred embodiment of the invention surrounding tracks 12, 14, 16, 18, and 20 of FIG. 2, are also made from string and are carried by fitted band 10. These surrounding tracks generally surround the rear portion of the head of wearer B. Horizontal hair openings 22, 24, 26, 28 and 30 are defined by fitted band 10 and the surrounding tracks. These spaced hair openings are generally horizontal in appearance and allow the hair of the wearer to be pulled through the hair openings to define personal hair or natural hair sections.

FIG. 5 shows personal hair sections 32,33, and 34 as well as appliance hair 35, 36,37, and 38 extended from the wearer's head to emphasize the distinction between these members. The surrounding tracks 16, 18, and 20 and fitted band 10 define hair openings 26, 28, and 30. These hair openings allow personal hair 32, 33 and 34 of the wearer to be pulled through the hair openings. When the personal hair 32 and 34 is pulled through the hair openings 26 and 28 respectively, the personal hair is blended with the appliance hair to produce a natural, comfortable, attractive appearance. Appliance hair 35 and 37 and personal hair section 33 are shown blended together to provide a natural, attractive appearance C. It should also be noted that the appliance hair, while shown carried by the surround tracks and the fitted band, the appliance hair need not be carried by both. For example, a front bang sections can exist carried by the front portion of the top surround track to provide for naturally appearing bangs, or, no bang section provided allowing the wearer's forehead to be visible.

Figure 4:
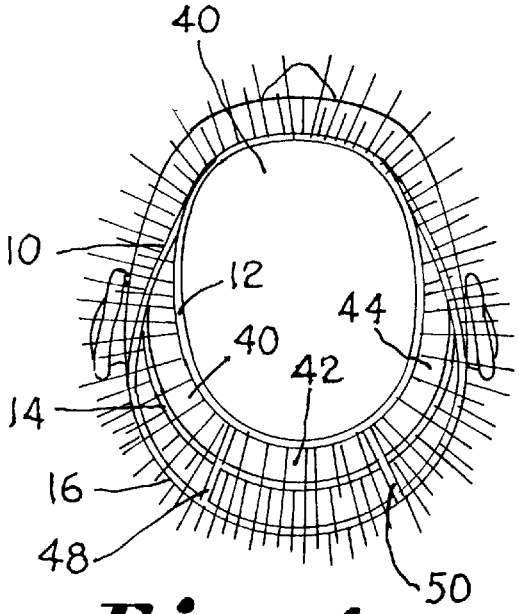
FIG. 4 is a top plan view showing the invention being worn, the natural hair of the wearer has been removed for illustrative purposes.

In the preferred embodiment of the invention, vertical spacer 48 of FIG. 1 is carried by the fitted band and the surrounding tracks. This vertical spacer provides for vertical spacing of the surrounding tracks when the hair appliance is worn and prevents surrounding tracks 14,16,18, and 20 from slipping down the back of the wearer's head when the hair appliance is worn. Hair opening 22 is shown divided by vertical spacer 48 in FIG. 4 which defines lateral hair openings 40, 42 and 44. Vertical spacer 48 also divides hair openings 22, 24, 26, 28, and 30 of FIG. 2 into lateral hair openings since vertical spacer 48 intersects the surrounding tracks. By dividing the hair openings with vertical spacers 48 and 50, even more hair openings are provided through which personal hair can be pulled allowing for the blending of the wearer's and the appliance hair. While vertical spacers 48 and 50 are illustrated as a continuous strand, it is to be understood, of course, that individual, staggered strands between the appliance hair tracks may be utilized. Broadly speaking, the head net A includes a plurality of vertical and horizontal spaced hair openings defined by intersecting appliance hair tracks through which personal hair is pulled through to blend with appliance hair.

In FIG. 3, top surrounding track 12 defines a top hair opening 46. Top hair opening 46 allows a major top hair section 52 to be pulled through the top hair opening. As can best be seen in FIG. 4, top surrounding track 12 surrounds a majority of the top of a person's head when worn. Top hair section 52 overlaps top surrounding track 12 and blends with the personal hair of the wearer. While shown as extending only to the top surrounding track, the personal hair section 52 can extend to any length desirable to the wearer.

Together, the fitted band, surround tracks, and vertical spacers provide a head net in a general bowl shape for conforming to the wearer's head. Appliance hair carried by the head net and blended with the wearer's personal hair provides a natural, attractive, comfortable hair supplement which overcomes many of the disadvantages of the traditional wigs or hair weaves.

While a preferred embodiment of the invention has been described using specific terms, such description is for illustrative purposes only. It is to be understood that changes and variations may be made without departing from the spirit or scope of the following claims.

What is claimed is:

1. A hair appliance for supplementing the personal hair of a person when worn comprising:

a head net for fitting upon the person's head when the hair appliance is worn;

a lowermost continuous fitted band included in said head net for encircling the person's head generally from the forehead to the nape of the neck and above the ears, and said fitted band defining a lowermost head net opening through which said head net is fitted over the person's head when worn;

a top surrounding track included in said head net for extending around a major top portion of the person's head when worn, and said top surrounding track being affixed to and intersecting said fitted band;

a major top opening defined by said fitted band and said intersecting top surrounding track for receiving personal hair of the person to create a major top personal hair section when the appliance is worn, said major top opening being generally unobstructed for styling the top personal hair section without interference from said head net in said top opening when said hair appliance is worn;

a plurality of lower surrounding tracks included in said head net disposed between said fitted band and said top surrounding track, said lower surrounding tracks being interconnected with said fitted band;

a generally vertical spacer included in said head net extending between said top surrounding track and said fitted band spacing said lower surrounding tracks apart when said head net is worn, said vertical spacer preventing said lower surrounding tracks from slipping downward when said hair appliance is worn and fitted;

said fitted band, said top surrounding track, said lower surrounding tracks, and said vertical track defining a plurality of hair openings through which personal hair may be pulled when said appliance is worn to create personal hair sections; and appliance hair carried by at least some of said top surrounding tracks and lower surrounding tracks to create sections of appliance hair for blending with the natural hair sections when said appliance is worn so that a naturally appearing, aesthetically appealing hair supplement is provided.

2. The device of claim 1 wherein said fitted band, said top surrounding track, said lower surrounding tracks, and said vertical spacer are made from thin string which is virtually undetectable so that said head net is unnoticeable to an ordinary observer when said hair appliance is worn whereby a naturally appearing hair appliance is provided.

3. The device of claim 2 wherein said fitted band is generally inclined and said top and lower surround tracks are generally horizontal and parallel to one another when said head net is worn.

4. The device of claim 3 further comprising a plurality of a vertical spacers spacing said top and lower surround tracks so that a comfortable, naturally appearing, aesthetically appealing hair supplement is provided.

5. The device of claim 4 wherein:

said appliance hair includes individual hair strands having a secured end secured to at least said top surrounding track and terminating as a free end; and said free end hanging downward from at least said top surrounding track and overlaying at least one of said lower surrounding tracks.

6. The device of claim 5 wherein said secured end of said appliance hair having a loop around said surrounding tracks which secures said strand to said tracks.

7. The device of claim 6 wherein said appliance hair is carried by said fitted band so that naturally appearing bangs are provided.

* * * * *